US008578899B2

(12) United States Patent
Ottersbach et al.

(10) Patent No.: US 8,578,899 B2
(45) Date of Patent: Nov. 12, 2013

(54) CAMSHAFT ADJUSTER

(75) Inventors: Rainer Ottersbach, Aurachtal (DE); Jürgen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/382,970

(22) PCT Filed: Jun. 4, 2010

(86) PCT No.: PCT/EP2010/057818

§ 371 (c)(1), (2), (4) Date: Mar. 30, 2012

(87) PCT Pub. No.: WO2011/003681

PCT Pub. Date: Jan. 13, 2011

(65) Prior Publication Data

US 2012/0184378 A1 Jul. 19, 2012

(30) Foreign Application Priority Data

Jul. 7, 2009 (DE) ..... 10 2009 031 934

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 6,530,351 | B2 * | 3/2003 | Mikame | 123/90.15 |
| 2008/0236529 | A1 * | 10/2008 | Scheidig et al. | 123/90.17 |

FOREIGN PATENT DOCUMENTS

| | | |
|---|---|---|
| CN | 101196131 | 6/2008 |
| DE | 10084408 | 2/2004 |
| DE | 102005007942 | 9/2005 |
| DE | 102008023151 | 3/2009 |
| EP | 1865158 | 12/2007 |
| JP | 11036825 | 2/1999 |
| JP | 2000161028 | 6/2000 |
| JP | 2000240414 | 9/2000 |
| JP | 2003262109 | 9/2003 |
| JP | 2005351182 | 12/2005 |

OTHER PUBLICATIONS

Machine Translation for JP2000 161,028.*

* cited by examiner

*Primary Examiner* — Zelalem Eshete
(74) *Attorney, Agent, or Firm* — Volpe and Koenig, P.C.

(57) ABSTRACT

A camshaft adjuster (1) having a stator (3) and a rotor (5) located in the stator (3), having vanes (7) that are each located in a chamber (9) formed between the stator (3) and the rotor (5), each of the vanes (7) dividing its respective chamber (9) into two partial chambers, and pressurized oil being adapted to be supplied to each of the partial chambers and conducted out from each of the partial chambers via oil channels (21), so that through the pressurized oil a torque can be exerted on the rotor (5) by which the rotor (5) can be rotated, so that a camshaft adjustment can be set thereby. The rotor (5) is constructed from a metallic base frame (15) that has, axially adjacent, a casing (17) made of plastic in which at least one of the oil channels (21) is formed.

9 Claims, 3 Drawing Sheets

CAMSHAFT ADJUSTER

BACKGROUND

The present invention relates to a camshaft adjuster.

From DE 100 84 408 B4, a camshaft adjuster having a vane-cell design is known whose drive element, in the form of a drive gear, is driven by a crankshaft via a traction mechanism such as a chain or a belt. Connected to the drive wheel so as to co-rotate fixedly therewith is a stator in which a rotor is rotatably located in order to produce a positioning angle. The rotor is connected to a camshaft so as to co-rotate fixedly therewith. A relative angular position between the camshaft and drive wheel, and thus the crankshaft, can be influenced as determined by the positioning angle, accompanied by an adjustment of the control times. In a vane-cell design, the rotor has vanes that are displaceable in the circumferential direction in a manner determined by a hydraulic pressure in control chambers of the stator, in order to produce a positioning angle. On the side facing away from the camshaft, the stator is fashioned with a disk that limits the control chambers in the axial direction. The force relationships between the rotor and the stator, in addition to the hydraulic relationships, in the area of the vanes are influenced by a torsion spring.

A pin referred to in the prior art document as a locking pin is displaceably held in a bore of the rotor parallel to the longitudinal axis of the camshaft adjuster, and the axial position of the pin can be influenced by the force relationships of a pressure spring and/or the hydraulic relationships in the area of end surfaces of the pin. The disk of the stator has a corresponding blind-hole type opening oriented in the axial direction. For an activated position of the pin, in particular a start position, intermediate position, center position, early position, or late position, an end area of the pin exits from the rotor and enters into the opening of the disk of the stator, so that the degree of rotational freedom between the rotor and the stator is limited.

JP 2000161028 A discloses a camshaft adjuster having a vane-cell design in which the rotor is made of aluminum and has a hub made of steel having radially protruding supports for the vanes. The steel hub is radially internally embedded in the aluminum rotor. Through the use of the aluminum rotor, an optimal adjustment of the play between rotor and stator is achieved.

SUMMARY

The present invention is based on the object of providing a camshaft adjuster that has particularly low weight, without limiting its mechanical load-carrying ability.

According to the present invention, this object is achieved by providing a camshaft adjuster, having a stator and a rotor located in the stator, that has vanes, each of which is situated in a chamber formed between the stator and the rotor, the vanes each dividing their respective chamber into two partial chambers, such that, via oil channels, pressurized oil can be supplied to each partial chamber and pressurized oil can be conducted out from each partial chamber, so that the pressurized oil can exert a torque on the rotor by which the rotor can be rotated so that a camshaft adjustment can thus be set, the rotor being constructed from a metallic base frame having, axially adjacent, an encasing made of plastic in which at least one of the oil channels is formed.

The present invention thus proposes for the first time a camshaft adjuster in which the mechanically highly loaded rotor has essential parts made of light plastic, thus significantly reducing the overall weight. Nonetheless, no significant limitation of the mechanical loadability of the rotor results, due significantly to its somewhat layered design in the axial direction. The width of the rotor required for the pressure transmission is essentially achieved via the plastic casing, the centrifugal and bearing forces on the rotor being largely borne by the metallic base frame, which however can be made relatively thin axially and thus kept light in weight.

Preferably, the base frame is made of steel, which is preferably sintered. Production by sintering makes it possible to easily form more complex structures in the base frame without the material loss associated with cutting manufacture.

Preferably, the base frame has a hub for central fastening of the camshaft adjuster. In this way, a part of the rotor subject to particularly high mechanical loading is formed by the metallic base frame, ensuring resistance to wear.

Preferably, the base frame has a locking guide for a locking mechanism for locking a rotation of the rotor. The locking mechanism is preferably a pin. In a locking device, significant forces can occur that can be absorbed by the metallic guide.

Preferably, the base frame has a disk having an axial disk width and having for each vane, a vane frame extending radially outward from the disk. The vane frame has radially running webs having an axial web width that is greater than the width of the disk. Preferably, the vane frame forms a vane tip that extends over the entire axial vane width. This design stabilizes the mechanically loaded vane via the webs of the vane frames, such that the base frame can otherwise be realized as a thin disk and is therefore particularly light.

Preferably, the base frame has an opening in which a corresponding pedestal of the casing engages in such a way that the base frame is connected to the casing with respect to forces acting in the circumferential direction. The direction of engagement of the pedestal in the opening is preferably radial. Preferably, a plurality of openings and pedestals are provided.

Preferably, the casing is sprayed onto the base frame. On the one hand this achieves a simple manufacture, and on the other hand it achieves a good connection to the base frame.

Preferably, the casing is positively connected to the base frame. This is preferably achieved through the engagement of the pedestals in the openings. Here, parts of the casing situated axially opposite one another can also be connected to one another, e.g. glued or welded together. This is possible for example in that a pedestal of the casing part that passes through an opening of the base frame comes into contact with the other casing part and is connected there. Preferably, this takes place in alternating fashion, such that one or more pedestals extend through openings in the base frame, both from the one axial side of the base frame and from the other axial side. In this way, forces in the circumferential direction for all casing parts are absorbed by the pedestals and openings, and not via the adhesive or welded points.

Preferably, the casing is constructed from a plurality of parts arranged in the circumferential direction, most of these parts being of identical construction. For example, each part can be situated between two respective chambers in the circumferential direction, and each part can for example have a pedestal for engagement in the base frame. The casing part that is situated at the locking device can deviate in its constructive shape and can have an opening for the locking device. This modular design enables simple manufacture of the casing that is later assembled together with the base frame.

BRIEF DESCRIPTION OF THE DRAWINGS

The present invention is explained on the basis of an exemplary embodiment.

DETAILED DESCRIPTION OF THE PREFERRED EMBODIMENTS

Figure 1:
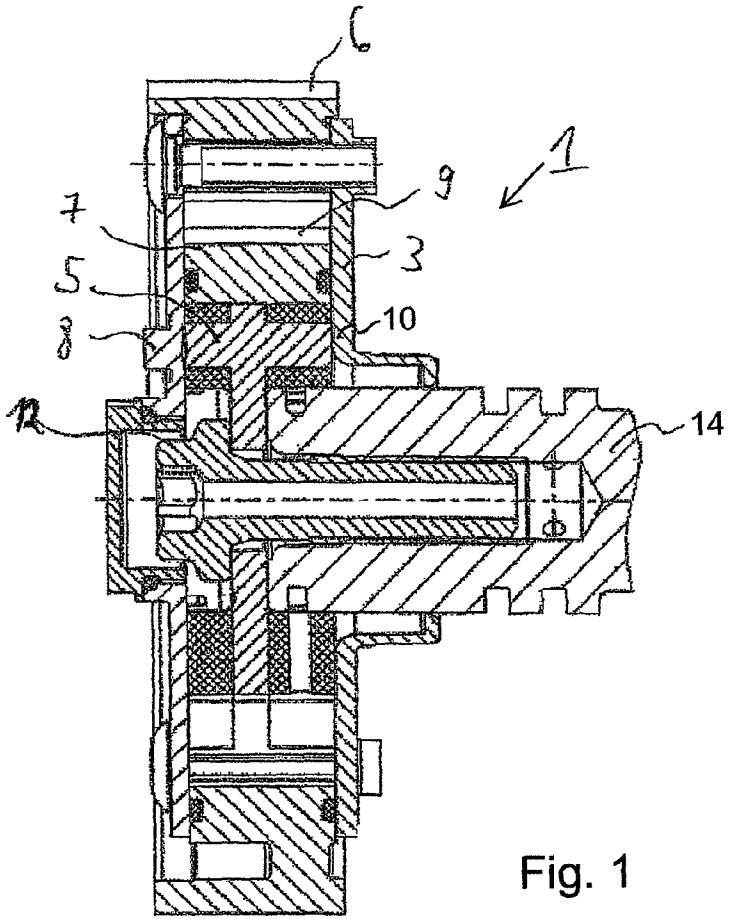
FIG. 1 shows a section through a camshaft adjuster.

FIG. 1 shows a longitudinal sectional view of a camshaft adjuster 1. In this example, camshaft adjuster 1 is realized as a belt adjuster; i.e., it is driven by a crankshaft (not shown) via a belt (not shown). The belt engages a first drive wheel 6 that is connected to a stator 3 of camshaft adjuster 1. Via side covers 8 and 10, stator 3 encloses a rotor 5, and in this way forms chambers 9 into each of which there extends a respective vane 7 of the rotor 5. In the depicted example, five chambers 9 and five vanes 7 are present. Vanes 7 each divide their respective chamber 9 into two partial chambers in the circumferential direction. By supplying pressurized oil to one of these two partial chambers and conducting pressurized oil out from the respective other partial chamber, a positioning force is exerted on vane 7 that results in a torque on the rotor 5, so that the rotor 5 is adjusted in the circumferential direction. This also results in an adjustment in the angular position of the drive wheel 6 relative to the camshaft 14, and thus to the desired modification of the phase position of the camshaft relative to the crankshaft. The camshaft adjuster 1 is fastened via a central fastening screw 12 to the camshaft 14 of an internal combustion engine. The design of the rotor 5 is explained in more detail below.

Oil channels 21 lead to the first partial chambers (not shown here), while on the rear side (not shown) further oil channels lead to the respective second partial chambers. Through the use of a locking mechanism 25 held in a locking guide 23, the rotor 5 can be locked relative to the stator 3, so that no rotation is possible. The rotor 5 is constructed from a steel base frame 15 and a plastic casing 17, as is described in more detail on the basis of the following Figures.

Figure 2:
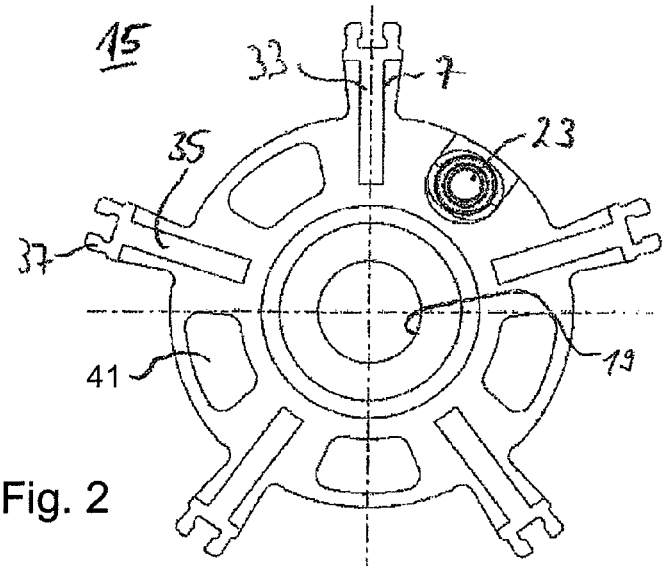
FIG. 2 shows a top view of a base frame of a rotor.
Figure 3:
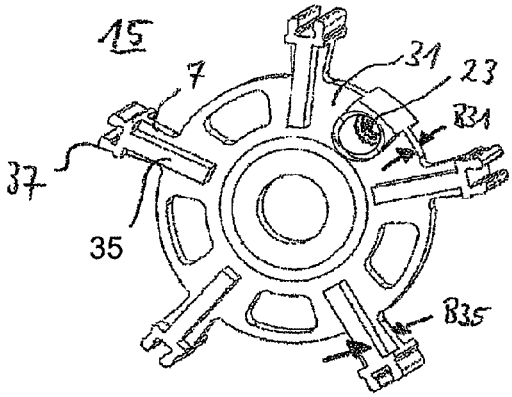
FIGS. 3 and 4 show perspective views of the base frame of FIG. 2.
Figure 4:
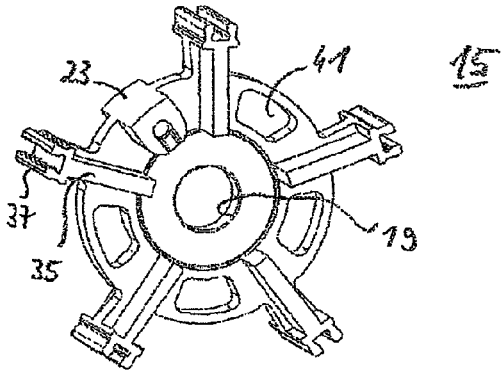

FIG. 2 shows a base frame 15 of the rotor 5, made of sintered steel. FIGS. 3 and 4 show the associated perspective views of the front and rear side. The base frame is formed of a disk 31, vane frames 33, and a locking guide 23. The disk 31 forms a hub 19 through which the fastening screw 12 is guided. Five vane frames 33 that protrude outward are connected to the disk 31. The vane frames 33 each have radially running webs 35 to which vane tips 37 are connected. The axial web width B35 of the base frame is larger than an axial disk width B31, and is equal to the axial width of vane tip 37. In this way, a mechanical reinforcement of base frame 15 is achieved locally by the vane frames 33. A locking guide 23 also extends over an axial width that is equal to the axial width of the vane tips 37. This also provides axial support for an axial bearing that is mechanically loadable and resistant to wear. The forming of hub 19 and vane tips 37 via the base frame 15 also results in a loadable radial bearing of rotor 5. In order to save weight, the disk 31 is made comparatively thin, and also has openings 41 that further reduce weight. These openings 41 are also used for engagement of pedestals 43 of a plastic casing 17 that is attached axially on both sides of the base frame 15 and is explained in more detail below.

Figure 5A:
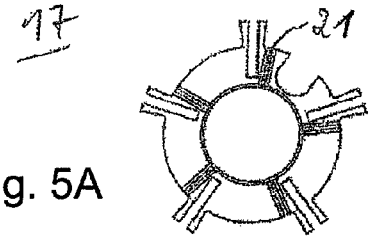
FIG. 5A shows a top view of a plastic casing.
Figure 5B:
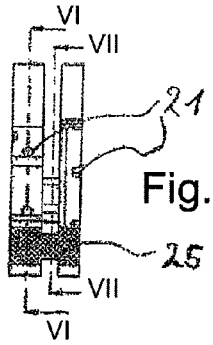
FIG. 5B shows a side view of the plastic casing of FIG. 5A.
Figure 6:
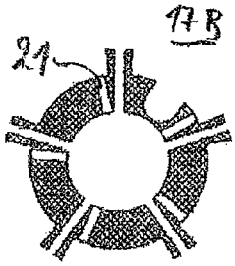
FIGS. 6 and 7 show sections through the plastic casing shown in FIG. 5B.
Figure 7:
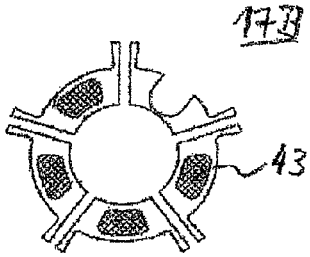
Figure 8:
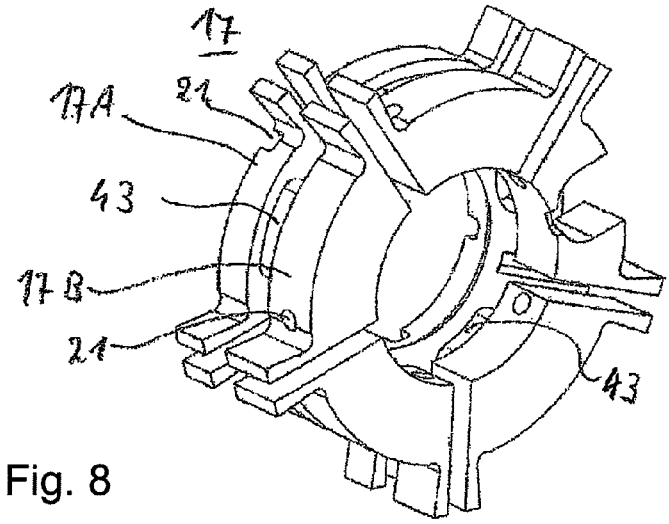
FIG. 8 shows a perspective view of the plastic casing of FIG. 5A.

FIG. 5A shows a plastic casing 17. FIG. 5B shows an associated side view, and FIGS. 6 and 7 show the sections depicted in FIG. 5B. FIG. 8 shows a perspective view of the plastic casing 17. This casing is for example sprayed onto the base frame 15, or is built together therewith. The casing 17 has oil channels 21 that guide the pressurized oil to chambers 9. In a first casing part 17A, oil channels 21 are realized as grooves that, in the assembled state, form oil channels 21 together with the side covers of stator 3. The first casing part 17A is made axially thinner than a second casing part 17B that is axially situated on the other side of the base frame 15. In this second casing part, the oil channels 21 are fashioned as bores. The casing 17 has pedestals 43 whose shape and position are made such that when connected to base frame 15 they engage through openings 41 therein. This results in a connection of base frame 15 with the casing 17 that is rigid, particularly in the circumferential direction.

The invention claimed is:

1. A camshaft adjuster comprising a stator and a rotor situated in the stator, the rotor having vanes that are each situated in a chamber formed between the stator and the rotor, each of the vanes dividing a respective chamber into two partial chambers, and pressurized oil being adapted to be supplied to each of the partial chambers and conducted out from each of the partial chambers via oil channels, so that through the pressurized oil a torque can be exerted on the rotor by which the rotor can be rotated, so that a camshaft adjustment can be set thereby, the rotor is constructed from a metallic base frame that has an axially adjacent casing made of plastic in which at least one of the oil channels is formed, and said base frame has a disk having an axial disk width and has for each of the vanes, a vane frame that extends radially outward from the disk, said vane frame having radially running webs having an axial web width that is greater than the axial disk width.

2. The camshaft adjuster as recited in claim 1, wherein the base frame is formed from steel.

3. The camshaft adjuster as recited in claim 2, wherein the steel is sintered.

4. The camshaft adjuster as recited in claim 1, wherein the base frame forms a hub for a central fastening of the camshaft adjuster.

5. The camshaft adjuster as recited in claim 1, wherein the base frame has a locking guide for a locking mechanism for locking a rotational position of the rotor.

6. The camshaft adjuster as recited in claim 1, wherein each of the vane frames includes a vane tip that extends over an entire axial vane width.

7. The camshaft adjuster as recited in claim 1, wherein the casing is sprayed onto the base frame.

8. The camshaft adjuster as recited in claim 1, wherein the casing is connected positively to the base frame.

9. A camshaft adjuster comprising a stator and a rotor situated in the stator, the rotor having vanes that are each situated in a chamber formed between the stator and the rotor, each of the vanes dividing a respective chamber into two partial chambers, pressurized oil being adapted to be supplied to each of the partial chambers and conducted out from each of the partial chambers via oil channels, so that through the pressurized oil a torque can be exerted on the rotor by which the rotor can be rotated, so that a camshaft adjustment can be set thereby, the rotor is constructed from a metallic base frame that has an axially adjacent casing made of plastic in which at least one of the oil channels is formed, and said base frame has an opening in which a corresponding pedestal of the casing engages in such a way that the base frame is connected to the casing with respect to forces acting in a circumferential direction.

* * * * *